United States Patent [19]

Deconinck

[11] Patent Number: 4,475,464

[45] Date of Patent: Oct. 9, 1984

[54] EXPANDABLE TABLE WITH PIVOTAL PANELS FLANKING REMOVABLE LEAF

[75] Inventor: Didier Deconinck, Seyssins, France

[73] Assignee: Allibert Exploitation, Grenoble, France

[21] Appl. No.: 425,859

[22] Filed: Sep. 28, 1982

Related U.S. Application Data

[63] Continuation-in-part of Ser. No. 147,739, May 8, 1980.

[30] Foreign Application Priority Data

May 10, 1979 [FR] France ..... 79 12513

[51] Int. Cl.[3] ..... A47B 1/02

[52] U.S. Cl. ..... 108/83; 108/86

[58] Field of Search ..... 108/83, 84, 72, 86, 108/85, 87, 69

[56] References Cited

U.S. PATENT DOCUMENTS

| | | | |
|---|---|---|---|
| 726,853 | 5/1903 | Borgmann | 108/72 |
| 859,710 | 7/1907 | Whonn | 108/83 |
| 1,849,092 | 3/1932 | Hunter | 108/72 |
| 1,927,282 | 9/1933 | Hansen | 108/72 |
| 2,016,353 | 10/1935 | Wokosin | 108/83 |
| 2,240,551 | 5/1941 | Cooper | 108/86 |
| 2,598,804 | 6/1952 | Larson | 108/83 |

FOREIGN PATENT DOCUMENTS

| | | | |
|---|---|---|---|
| 165773 | 2/1934 | Switzerland | 108/86 |

*Primary Examiner*—Francis K. Zugel

*Attorney, Agent, or Firm*—Karl F. Ross; Herbert Dubno

[57] ABSTRACT

An extendable table has a legged base defining a horizontal support surface extending in longitudinal and transverse directions and having a pair of outer transversely extending edges, a first table panel resting on the support surface and having a transversely extending inner edge intermediate and generally parallel to the outer edges, and a second table panel restable on the support surface, having a transversely extending inner edge buttable with the inner edge of the first panel, and formed with a pair of transversely open and longitudinally extending grooves. Respective rollers on the base underneath the second panel define a transversely extending first pivot axis, and extend transversely into guiding engagement with the grooves. Thus the second panel can slide longitudinally relative to the base on the rollers and can be pivoted on the rollers about the first pivot axis. A pair of parallel links each have one end pivoted about a second transverse axis on the base and generally parallel to the first transverse axis and another end pivoted on the second panel about another transverse axis. Thus the second panel can move with simultaneous pivoting about the first axis and sliding perpendicular thereto between an inner position with its inner edge butting the inner edge of the first panel and an outer position with its inner edge spaced from the inner edge of the first panel. A leaf is engageable in the outer position of the second panel between the inner edges.

10 Claims, 13 Drawing Figures

P
IV
IV
III

EXPANDABLE TABLE WITH PIVOTAL PANELS FLANKING REMOVABLE LEAF

CROSS REFERENCE TO RELATED APPLICATION

This application is a continuation-in-part of my copending patent application Ser. No. 147,739 filed May 8, 1980.

FIELD OF THE INVENTION

The present invention relates to an expandable table. More particularly this invention concerns a dining table having a leaf which can be inserted to increase the usable surface area of the table.

BACKGROUND OF THE INVENTION

It is known, as for example from U.S. Pat. Nos. 725,853 of Borgmann and 2,016,353 of Wokosin, to form the top of a table of two separate normally coplanar panels having confronting inner edges that normally abut. A complicated guide mechanism is provided that allows these panels to slide apart, sometimes along with the respective legs, to form a gap which can be filled by a leaf. This leaf may itself be hinged in half and stored under the two main panels of the table. Such arrangements are normally relatively difficult to operate, requiring at least two people to separate the panels so the leaf can be put in place. The mechanism for sliding the panels on the table base is normally relatively complex and failure-prone, corroding with time so as to make sliding of these panels relatively difficult.

Another main type of expandable table has two panels similar to those described above, but each supported on four links that are all parallel and that each have one end pivoted on the table base adjacent a respective corner of the respective panel and another end pivoted on the respective corner. The panels can therefore be displaced through 180° arcs from inner positions with their inner edges abutting to outer positions with their inner edges separated. Such a mechanism has proven extremely simple and efficient, making it relatively easy for one person to open up the table and add a leaf. The arrangement has the enormous disadvantage that any attempt to lift the table by means of the panels will tip them inward and dump anything on them toward the center of the table, all without lifting the base of the table off the floor until the panel has been raised quite a distance above the base.

Swiss patent No. 165,773 of Winkler discloses a table having a pair of panels supported by rigid pivot links so that these panels can be swung from a center position to an outer position. The panels move wholly pivotally, that is no part of them is constrained to straight-line movement. A leaf-spring arrangement holds them snugly in the outer position. The failing of this system is, once again, that the floppy panels are not adequately secured against upward movement so that, for example, an attempt to lift the table by the outer edges of the panels would merely tip these elements up.

U.S. Pat. Nos. 2,240,551 of Cooper, 1,927,282 of Hansen, and 1,849,092 of Hunter describe other standard slide-type arrangements with a raisable center leaf.

OBJECTS OF THE INVENTION

It is therefore an object of the present invention to provide an improved expandable leaf-type table.

Another object is the provision of such an expandable leaf-type table which overcomes the above-given disadvantages.

A further object is to provide such a table whose mechanism is simple and solid, yet which operates smoothly and which allows the table to be lifted by the extended panels if necessary.

SUMMARY OF THE INVENTION

These objects are attained according to the instant invention in an extendable table having a legged base defining a horizontal support surface extending in longitudinal and transverse directions and having a pair of outer transversely extending edges, a first table panel resting on the support surface and having a transversely extending inner edge intermediate and generally parallel to the outer edges, and a second table panel restable on the support surface, having a transversely extending inner edge buttable with the inner edge of the first panel, and formed with a pair of transversely open and longitudinally extending guides. Respective elements on the base underneath the second panel define a transversely extending first pivot axis, and extend transversely into guiding engagement with the guides. Thus the second panel can slide longitudinally relative to the base on the elements and can be pivoted on the elements about the first pivot axis. A pair of parallel links each have one end pivoted about a second transverse axis on the base and generally parallel to the first transverse axis and another end pivoted on the second panel about another transverse axis. Thus the second panel can move with simultaneous pivoting about the first axis and sliding perpendicular thereto between an inner position with its inner edge butting the inner edge of the first panel and an outer position with its inner edge spaced from the inner edge of the first panel. A leaf is engageable in the outer position of the second panel between the inner edges.

In accordance with this invention the first panel is also provided with a pair of transversely open and longitudinally extending guides and the respective outer edge of the base is similarly provided with a pair of elements extending transversely into guiding engagement with the guides of the first panel. Another such pair of parallel links is provided between the first panel and the base. Thus both of the panels can pivot between respective inner and outer positions.

With this arrangement it is a relatively simple matter for one person to pull the panels out into the outer position, since the support and guide structure is relatively simple and unlikely to jam. Once in the outer position the panels will provide an extremely good support surface. It is even possible to lift the table by means of the projecting ends of these panels in both the inner and outer positions of them, as such an upward force on these projecting ends will merely force the inner ends down against the table surface to lock the assembly tightly together. The system has, therefore, all the advantages of the prior art with none of the disadvantages.

According to another feature of this invention each of the panels has a lower surface provided with a pair of U-section rails forming grooves constituting the respective guides. The elements, which are rollers, engage in the respective grooves. In addition each of the rails has an inner L-section extension to which is pivoted the respective link.

The links according to this invention are parallel and generally coplanar in the inner and outer positions of the panels. Their one ends lie between the inner edges in the outer positions of the panel.

To secure the table together, it is provided with latch means engageable between the base and the panels for locking same flatly on the base in the inner and outer positions. As a result the assembly is as solid as a conventional nonexpandable table with a fixed tabletop. These latches only function to prevent limited downward pivoting of the panels; when the table is being carried by the panels they carry none of the weight.

The panels according to the invention have coplanar upper surfaces in the inner and outer positions. In addition the second axis lies between the first axis and the inner edge of the second panel.

DESCRIPTION OF THE DRAWING

The above and other features and advantages will become more readily apparent from the following, reference being made to the accompanying drawing in which.

SPECIFIC DESCRIPTION

Figures 1, 2, 3, 4, 5:
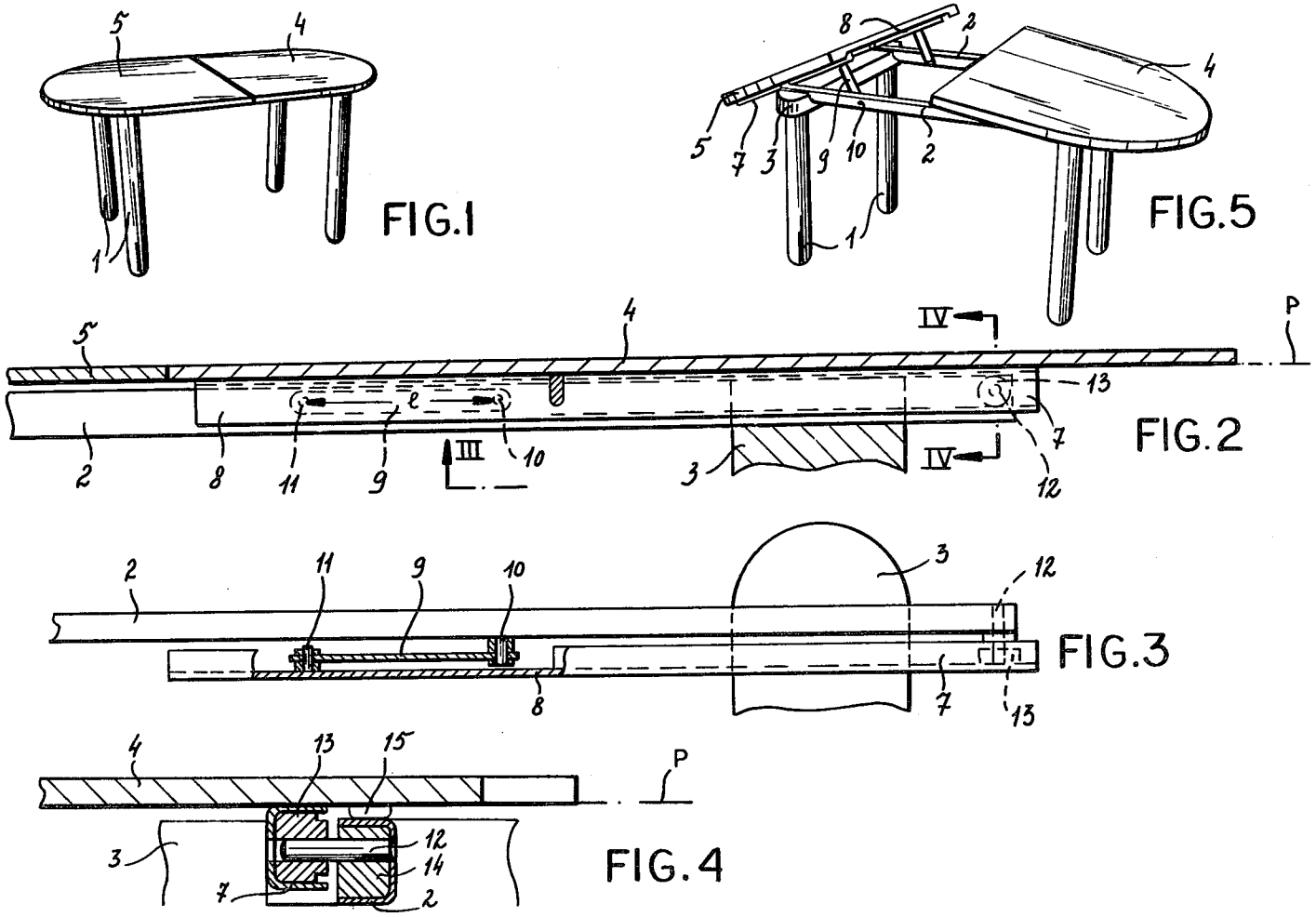
FIG. 1 is a perspective view of the table according to this invention with the surface-forming panels in the inner positions.
FIG. 2 is a vertical section in enlarged scale through a portion of the table of FIG. 1.
FIG. 3 is a bottom view partly in section taken in the direction of arrow III of FIG. 2.
FIG. 4 is a section taken along line IV—IV of FIG. 2.
FIG. 5 is a perspective view showing the table as one of its panels is moved into the outer position.

As seen in FIGS. 1–4 a table according to the instant invention has a base comprised of four legs 1 between which extend a pair of longitudinally extending horizontal members 2 and a pair of transversely extending horizontal members 3. Surface-forming planar panels 4 and 5 normally lie atop the plane P defined by the upper surface of the base 1, 2, 3.

Screwed to the underside of each of the panels 4 and 5 is a pair of similar U-section metal rails 7 opening transversely outward parallel to the plane P. The inner ends of these rails 7 continue as L-section extensions 8 each having an upper flange screwed to the respective panel and a vertically extending flange. Links 9 are each secured by means of a pivot 10 to the respective longitudinal member 2 and a pivot 11 to the respective vertical flange of the respective extension 8. These links 9 have between their axes 10 and 11 overall lengths 1. These pivot axes 10 and 11 are all tansverse and coaxial, that is they extend perpendicular to the longitudinal members 2.

Each longitudinal member 2 is of U-section like the rails 7 and is provided adjacent its longitudinal outermost end with an axle 12 that is seated in a filler block 14 in the respective member 2 and that carries on its free end a roller 13 engaged in the respective rail 7. The panels 4 and 5 can therefore not only pivot about the respective coaxial axles 12, but can also slide therealong within the limits of motion defined by the respective links 9. The undersides of the panels 4 and 5 are provided with hard elastomeric bumpers 15 that lie on top of the longitudinal members 2.

As seen in FIGS. 10–13, the longitudinal members 2 are each provided with two longitudinally spaced latch dogs 20 pivotal about parallel transverse axes 21. In addition each panel 4 and 5 is provided on its underside with a hook or keeper 22 for the respective dog 20. The panel 4 is formed on its inner edge with a transversely extending ridge or tongue 24 and the corresponding inner edge of the other panel 5 has a complementary groove 25.

Figure 9:
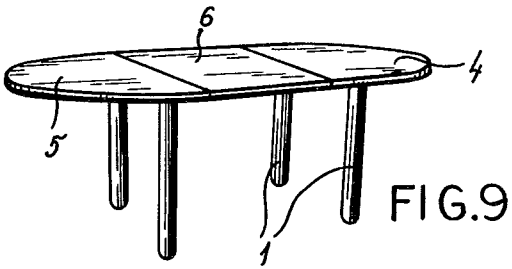
FIG. 9 is a perspective view showing the table with its two panels in the outer positions.
Figure 7:
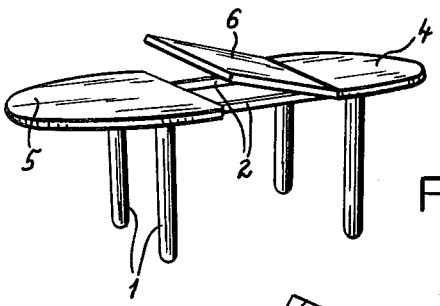
FIG. 7 is a perspective view showing the insertion of a leaf into the table with the panels in the open position.
Figure 6:
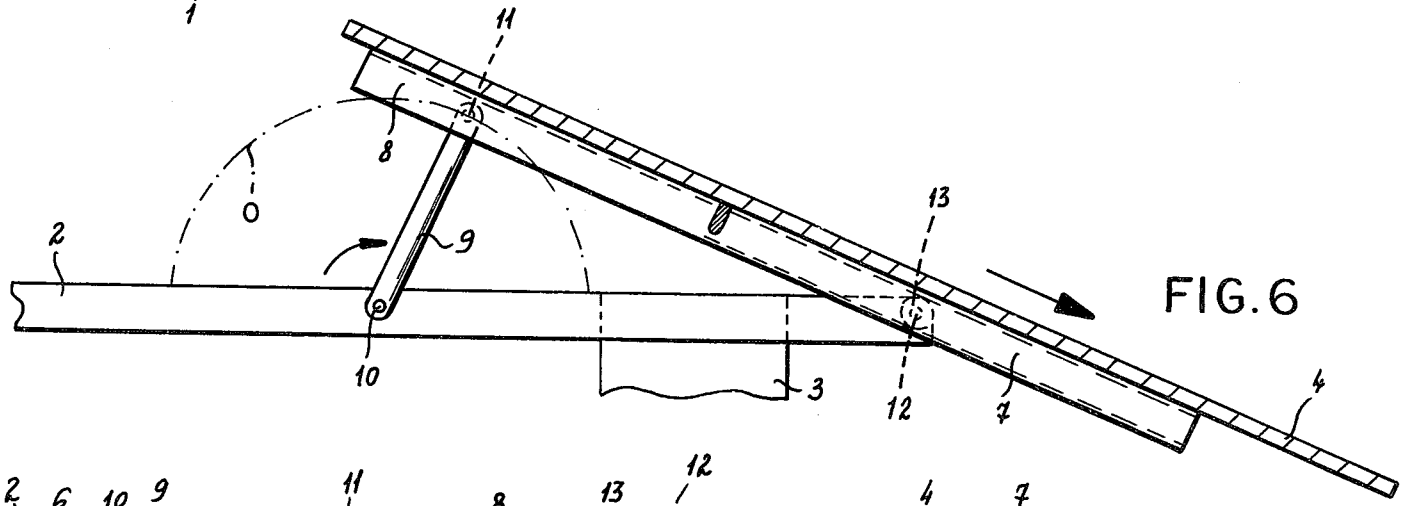
FIG. 6 is a section in enlarged scale through the table as shown in FIG. 5.
Figure 8:
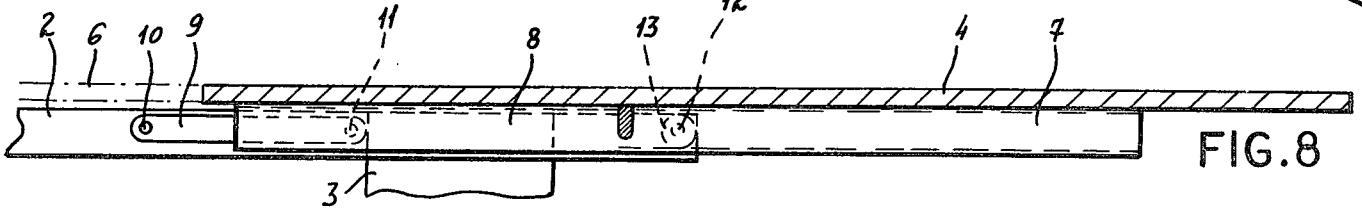
FIG. 8 is a sectional view similar to FIG. 2 but showing the panel in the outer position.
Figure 10:
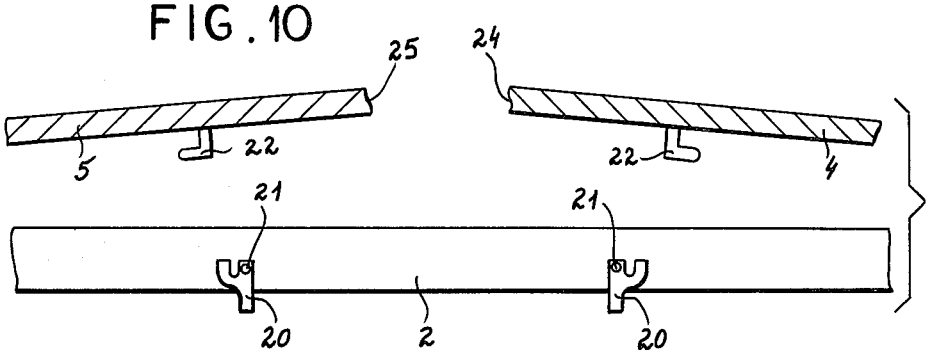
FIGS. 10 and 11 are longitudinal sections through the table showing the panels moving into and being latched in the inner positions.
Figure 11:
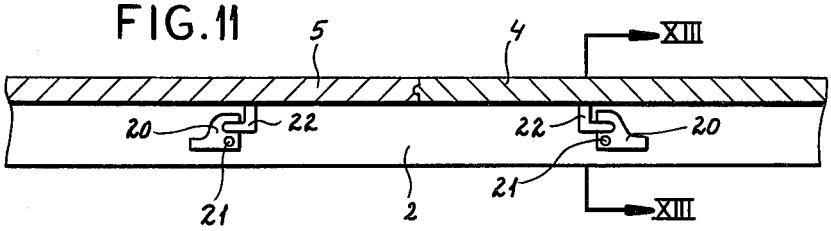

In order to convert the relatively small table of FIG. 1 to the relatively large table of FIG. 9 the user pivots the latch dogs 20 out of the respective keepers 22 and then pushes down on the outer edge of each of the panels 4 and 5 to pivot them as shown for the panel 5 in FIG. 5, with the inner panel edge moving up and the outer one moving down. Simultaneously the panels 4 and 5 are slid out, with the rollers 13 moving along the rails 7 as seen in FIG. 6. The pivots 11 will meanwhile describe an orbit 0 centered on the respective coaxial pivots 10. The rails 7 will ride outward on the respective rollers 13 until the panels 4 and 5 flatten out as shown in FIG. 8 on the plane P on top of the members 2 and 3, displaced outward by a distance equal to exactly twice 1, which distance is equal to the diameter of the orbit 0. In this position the pivots 11, which hitherto lay between the pivots 10, lie outside these pivots 10.

Figure 12:
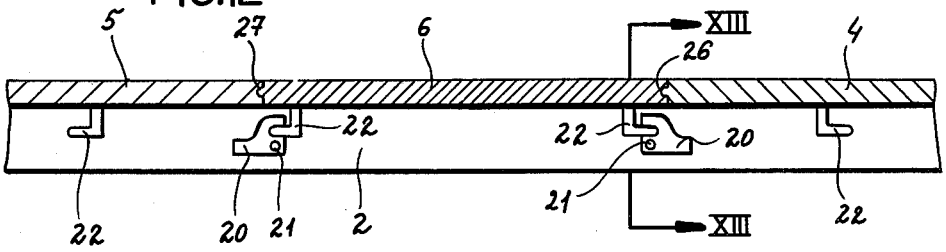
FIG. 12 is a section like FIGS. 10 and 11 but showing the panels in the outer positions and a leaf latched in place between them.
Figure 13:
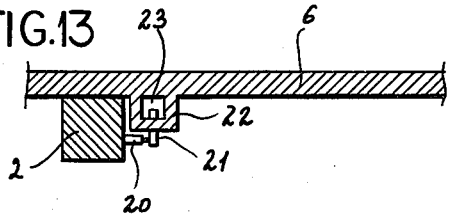
FIG. 13 is a section taken along line XIII—XIII of FIG. 12.

A leaf 6 having an overall length equal to 4 times 1 can then be rested on top of the members 2 between the inner edges of the panels 4 and 5. This leaf 6 is formed along one edge with a groove 26 identical to the groove 25 and along its opposite edge with a ridge or tongue 27 identical to the tongue 24. With a little rocking of one of the panels 4 or 5 it is possible to fit these formations 24–27 together as shown in FIG. 12. The latch dogs 20 can then be pivoted through keeper eyes 22 on the leaf 6 identical to the keepers 22 on the panels 4 and 5. This action locks the leaf 6 in place and simultaneously secures the two panels 4 and 5 tightly on the plane P due to the longitudinally interfitting tongues 24 and 27 and grooves 25 and 26.

In either the short-table position shown in FIG. 1 with the panels 4 and 5 in their inner positions or the long-table postion of FIG. 9 with the panels 4 and 5 in their outer positions it is possible to lift the entire assembly by the panels 4 and 5. In addition it is possible to use a leaf 6 having a width equal to twice 1, to be used when only one of the panels 4 or 5 is pivoted into the outer position for limited extension of the table.

I claim:

1. An extendable table comprising:

a legged base defining a horizontal support surface extending in longitudinal and transverse directions and having a pair of outer transversely extending edges;

a first table panel resting on the surface and having a transversely extending inner edge intermediate and generally parallel to the outer edges;

a second table panel restable on the support surface, having a transversely extending inner edge buttable with the inner edge of the first panel, and formed with a pair of transversely open and longitudinally extending guides;

respective elements on the base underneath the second panel, defining a transversely extending first pivot axis, and extending transversely into guiding engagement with the guides, whereby the second panel can slide longitudinally relative to the base on the elements and can be pivoted on the elements about the first pivot axis;

a pair of parallel links each having one end pivoted about a second transverse axis on the base and generally parallel to the first transverse axis and another end pivoted on the second panel about another transverse axis, whereby the second panel can move with simultaneous pivoting about the first axis and sliding perpendicular thereto between an inner position with its inner edge butting the inner edge of the first panel and an outer position with its inner edge spaced from the inner edge of the first panel; and a leaf engageable in the outer position of the second panel between the inner edges.

2. The expandable table defined in claim 1 wherein the first panel is provided with a pair of transversely open and longitudinally extending guides and the respective outer edge of the base is similarly provided with a pair of elements extending transversely into guiding engagement with the guides of the first panel, the table further comprising another such pair of parallel links between the first panel and the base, whereby both of the panels can pivot between respective inner and outer positions.

3. The expandable table defined in claim 2 wherein each of the panels has a lower surface provided with a pair of U-section rails forming grooves constituting the respective guides, the elements engaging in the respective grooves.

4. The expandable table defined in claim 3 wherein the elements are rollers.

5. The expandable table defined in claim 3 wherein each of the rails has an inner L-section extension to which is pivoted the respective link.

6. The expandable table defined in claim 2 wherein the links are parallel and generally coplanar in the inner and outer positions of the panels.

7. The expandable table defined in claim 2 wherein the one ends of the links lie between the inner edges in the outer positions of the panel.

8. The expandable table defined in claim 2, further comprising latch means engageable between the base and the panels for locking same flatly on the base in the inner and outer positions.

9. The expandable table defined in claim 2 wherein the panels have coplanar upper surfaces in the inner and outer positions.

10. The expandable table defined in claim 1, wherein the second axis lies between the first axis and the inner edge of the second panel.

* * * * *